US006474304B1

(12) United States Patent
Lei

(10) Patent No.: US 6,474,304 B1
(45) Date of Patent: Nov. 5, 2002

(54) DOUBLE-ACTING TWO-STAGE HYDRAULIC CONTROL DEVICE

(75) Inventor: Ning Lei, Oak Brook, IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/570,896

(22) Filed: May 15, 2000

Related U.S. Application Data

(60) Provisional application No. 60/134,763, filed on May 18, 1999.

(51) Int. Cl.[7] ..... F02M 37/04

(52) U.S. Cl. ..... 123/446; 123/496

(58) Field of Search ..... 123/446, 299, 123/300, 496, 445, 448, 451

(56) References Cited

U.S. PATENT DOCUMENTS

| | | | | |
|---|---|---|---|---|
| 4,449,507 A | | 5/1984 | Mayer | |
| 4,531,488 A | * | 7/1985 | Kawamaura | 123/300 |
| 4,878,471 A | * | 11/1989 | Fuchs | 123/446 |
| 4,940,037 A | * | 7/1990 | Eckert | 123/506 |
| 5,143,291 A | * | 9/1992 | Grinsteiner | 239/88 |
| 5,271,371 A | | 12/1993 | Meints et al. | |
| 5,479,901 A | | 1/1996 | Gibson et al. | |
| 5,597,118 A | | 1/1997 | Carter, Jr. et al. | |
| 5,640,987 A | | 6/1997 | Sturman | |
| 5,720,261 A | | 2/1998 | Sturman et al. | |
| 5,720,318 A | | 2/1998 | Nagarajan et al. | |
| 5,954,030 A | | 9/1999 | Sturman et al. | |
| 6,026,785 A | * | 2/2000 | Zuo | 123/446 |

FOREIGN PATENT DOCUMENTS

| | | |
|---|---|---|
| GB | 2064670 A | 6/1981 |
| WO | WO99-57430 A | 11/1999 |

OTHER PUBLICATIONS

S.F.Glassey, A.R.Stockner, and M.A. Flinn, Heui—A New Direction for Diesel Engine Fuel Systems, International Congress & Exposition, SAE International–The Engineering Society for Advancing Mobility Land Sea Air and Space, Mar. 1–5, 1993, pp. 1–11, 930270.

C.Cole, O.E.Sturman, D.Giordano, Application of Digital Valve Technology to Diesel Fuel Injection, Society of Automotive Engineers, Inc., 1999–01–0196, pp. 1–7.

* cited by examiner

*Primary Examiner*—Bibhu Mohanty
(74) *Attorney, Agent, or Firm*—Dennis Kelly Sullivan; Jeffrey P. Calfa; Neil T. Powell

(57) ABSTRACT

A hydraulic control device which may be used in a number of applications, including with a fuel injector, includes a control valve having a first and a second independently shiftable valve member, the control member being configurable to define a plurality of actuating fluid flow paths for controlling hydraulic flow therethrough. A fuel injector includes the aforementioned control valve. A method of hydraulic control includes a number of steps, including independently controlling the shifting of two valves in a control valve assembly to selectively control the flow of actuating fluid to an actuator.

21 Claims, 9 Drawing Sheets

FIG. 2
PRIOR ART
FIG. 2a
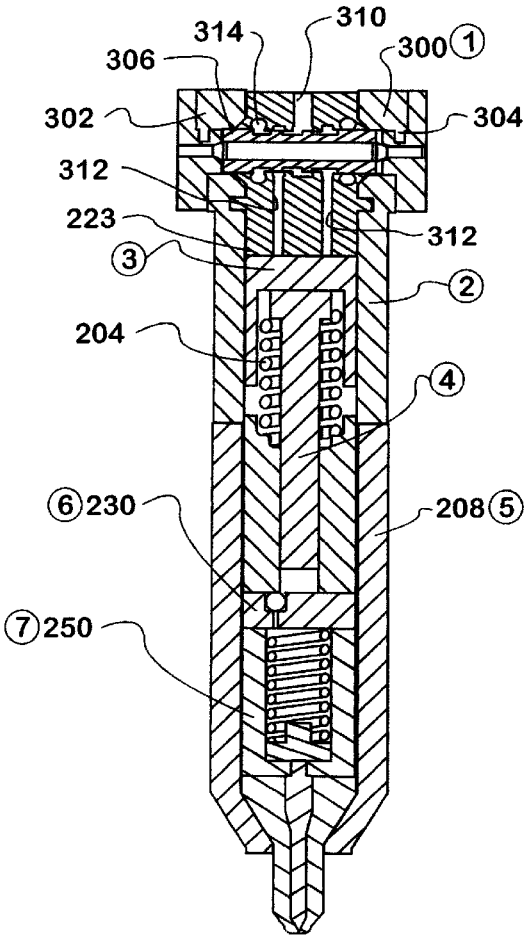
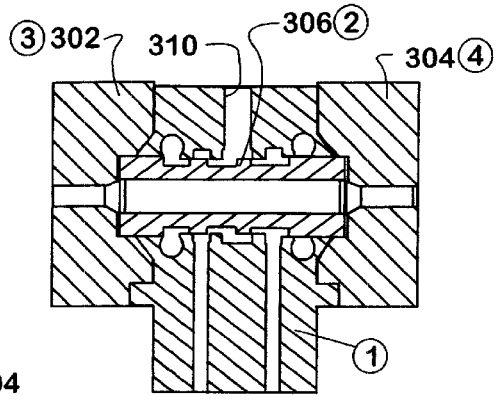
FIG. 2b
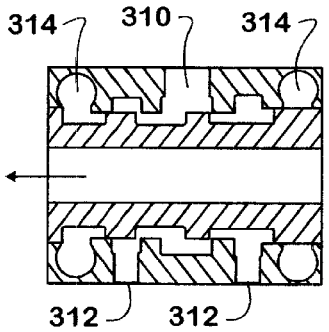
FIG. 2c
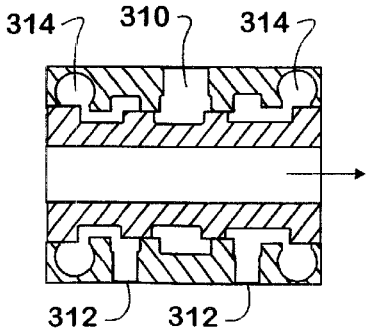
FIG. 2d

DOUBLE-ACTING TWO-STAGE HYDRAULIC CONTROL DEVICE

RELATED APPLICATION

The present application claims the benefit of U.S. Provisional Application No. 60/134,763, filed May 18, 1999, and incorporated herein in its entirety by reference.

BACKGROUND OF THE INVENTION

This concept is directed to a double-acting, two-stage flow control valve (DATS Valve) for use as a hydraulic control device. The present invention has use generally as a hydraulic control device and may be used, for example, in a camless engine. Additionally, the present application is directed specifically at the use of the hydraulic control device in combination with an intensified, low-pressure, common rail fuel injector used in a hydraulically-actuated, electronically-controlled unit injection (HEUI) system for an internal combustion engine, particularly a diesel engine, and the method of operating the control valve to selectively achieve pilot injection, rate shaping injection, far split injection, and single shot injection modes of operation of the fuel injector.

THE PRIOR ART

The prior art injectors used here for reference are the hydraulically-actuated, electronically-controlled unit injectors described in the following references, which are incorporated herein by reference: SAE paper No. 930270, "HEUI—A New Direction for Diesel Fuel Systems," and SAE paper No. 1999-01-0196, "Application of Digital Valve Technology to Diesel Fuel Injection" and U.S. Pat. Nos. 5,271,371, 5,479,901, 5,597,118, and 5,720,261, and 5,720,318.

A prior art HEUI injector 200 is depicted in prior art FIG. 1. HEUI 200 consists of four main components: (1) control valve 202; (2) intensifier 204; (3) nozzle 206; and (4) injector housing 208.

The purpose of the control valve 202 is to initiate and end the injection process. Control valve 202 is comprised of a poppet valve 210, having an attached armature 213, and an electric control solenoid 212. High pressure actuating oil from a high pressure rail 215 is supplied to the lower seat 214 of the poppet valve 210 through oil passageway 216. To begin injection, the electric control solenoid 212 is energized moving the poppet valve 210 upward from the lower seat 214 to the upper seat 218. This action admits high pressure oil to the spring cavity 220 and through the passage 222 to the piston chamber 223 of the intensifier 204. Injection continues until the solenoid of the electric control 212 is de-energized and the poppet 210 moves from the upper seat 218 to lower seat 214. Oil and fuel pressure then decrease as spent oil is ejected from the injector 200 through the open upper seat oil discharge 224 to the valve cover area of the internal combustion engine. The valve cover area is at ambient pressure.

The middle segment of the injector 200 includes the intensifier 204. The intensifier 204 includes the hydraulic intensifier piston 236, the plunger 228, fuel chamber 230, and the plunger return spring 232.

Intensification of the fuel pressure to desired injection pressure levels is accomplished by the ratio of areas between the upper surface 234 of the intensifier piston 236, acted on by the high pressure actuating oil and the lower surface 238 of the plunger 228, acting on the fuel in chamber 230. The intensification ratio can be tailored to achieve desired injection characteristics. Fuel is admitted to chamber 230 through passageway 240 past check valve 242. Injection begins as the high pressure actuating oil is supplied to the upper surface 234 of the intensifier piston 236.

As the intensifier piston 236 and plunger move downward responsive to the force exerted by the actuation oil, the pressure of the fuel in the chamber 230 below the plunger 228 rises dramatically. High pressure fuel flows in passageway 244 past check valve 246 to act upward on needle valve surface 248. The upward force on surface 248 opens needle valve 250 and fuel is discharged from orifice 252 into the combustion chamber of the engine. The intensifier piston 236 continues to move downward until the solenoid of the electric control 212 is de-energized causing the poppet valve 210 to return to the lower seat 214, thereby blocking actuating oil flow. The plunger return spring 232 returns the piston 236 and plunger 228 to their initial upward seated positions. As the plunger 228 returns upward, the plunger 228 draws replenishing fuel into the plunger chamber 230 across ball check valve 242.

The nozzle 206 is typical of other diesel fuel system nozzles. The valve-closed-orifice style is shown, although a mini-sac version of the tip is also available. Fuel is supplied to the nozzle orifice 252 through internal passages. As fuel pressure increases, the nozzle needle 250 lifts from the lower seat 254 to its open position, thereby allowing fuel injection to occur. As fuel pressure decreases at the end of injection, the spring 256 returns the needle 250 to its closed position against the lower seat 254.

FIGS. 2*a*, 2*b*, 2*c*, and 2*d* illustrate a prior art Digital Hydraulic Operating System (DHOS) injector and digital control valve operation. The intensifier and nozzle portions of the DHOS injector are similar to those of the HEUI injector and have been identified with the same reference numerals. However, in the DHOS injector, the poppet control valve 202 of the HEUI injector has been replaced by a spool type digital control valve 300 which is controlled by two solenoid coils 302, 304, the valve spool 306 which is made of magnetic material, being the armature. Thus, as illustrated in FIG. 2*c*, when the coil 302 is energized to begin an injection event or engine cycle during which an injection occurs, the valve spool 306 is pulled toward the coil 302 thereby open a fluid connection between the hydraulic fluid (high pressure lube oil) supply passage 310 and the working fluid passages 312 to the intensifier chamber 223 within the injector while isolating the vent passages 314. When the coil 302 is de-energized, the valve spool will remain in the open position shown in FIG. 2*c* due to residual magnetism in the valve spool 306.

To end the injection, the coil 304 is energized to pull the valve spool 306 rightward toward the coil 304 thereby establishing a fluid connection between the vent passages 314 and the working fluid passages 312 to the intensifier chamber 223 within the injector while isolating the hydraulic fluid supply passage 310.

With either the HEUI or the DHOS injector, the size of the control valve normally is targeted for a single injection operation for achieving maximum injection pressure. And it is also sized for good performance at low temperature operation when hydraulic fluid is relatively viscous. Once the size of the control valve is selected, the fuel delivery quantity may be determined based on the actuation pressure and valve open duration (pulse width duration). The maximum fuel delivery for these type injectors could reach 200 $mm^3$/stroke for full engine load condition. The minimum fuel delivery for engine at idle could be as small as 4 $mm^3$/stroke. Especially for the DHOS injector, the digital valve is also responsible for pilot injection operation. The pilot injection quantity can be as small as 1 $mm^3$/injection at maximum actuation pressure, approximately 3000 psi.

When a large size control valve is used for a small quantity of fuel delivery, significant performance variability is introduced during shot-to-shot and injector-to-injector operation. It is believed that this performance variability can be reduced if a smaller valve is used for small quantity operation and a large valve for full capacity operation.

SUMMARY OF THE INVENTION

The present invention is a valve for use generally as a hydraulic control device, such as, for example, in a camless internal combustion engine. One of the specific purposes of this invention is a control valve for a unit fuel injector, which can provide small flow when it is needed and can be switched to provide a larger flow rate when desired. Fundamentally, the control valve of the present invention has the ability to provide two-stage flow (high rate of flow and low rate of flow) with flexible controllability.

Many advanced diesel injector features, such as pilot injection, rate shaping, and efficient single shot injection, have been made available in various forms in prior injectors. All these features need to be available on a single injector for a diesel engine to achieve the goal of meeting ever more stringent emission regulations. With this invention, the user can flexibly choose between pilot injection, rate shaping injection, and single shot injection. The quantity of the fuel delivery and schedule of all events are flexibility selected and controlled.

This invention covers three different concepts. The first is a double-acting two stage (DATS) valve configuration as illustrated in the FIG. 3. The second concept is the combination of a DATS valve with a low pressure, intensified, hydraulically-actuated, electrically-controlled, common rail diesel fuel injector as shown in FIG. 6. The third concept is the operating strategies for the DATS injector to produce various modes of fuel injection as shown in FIG. 7 depending on various engine operating conditions. Although this valve concept can be used in many different applications, the direct application of this particular DATS valve is in diesel engine injection systems.

The present invention is a control valve assembly for use with a fuel injector, the fuel injector being controllable to define selected injection strategy of an injection event and includes a control valve having an inlet port and a drain port, the inlet port being in flow communication with a source of actuating fluid and the drain port being in flow communication with an actuating fluid drain having a first and a second independently shiftable valve member being configurable during an injection event to define a plurality of actuating fluid flow paths for controlling the injection event. The present invention is further a fuel injector that includes the aforementioned control valve. Additionally, the present invention is a method of controlling injection strategy of an injection event of a fuel injector which includes a number of steps, including the step of;

independently controlling the shifting of two valves in the control valve assembly to selectively control the flow of high pressure actuating fluid to the intensifier chamber to effect the desired injection strategy.

BRIEF DESCRIPTION OF THE DRAWINGS

FIG. 2*a* is a sectional elevational view of a prior art DHOS injector;

FIG. 2*b* is a sectional elevational view of the digital control valve portion of the prior art DHOS injector of FIG. 2*a;*

FIG. 2*c* is a sectional elevational view of the spool valve digital control valve portion of the prior art DHOS injector in the open disposition;

FIG. 2*d* is a sectional elevational view of the spool valve of digital control valve portion of the prior art DHOS injector in the open disposition;

DETAILED DESCRIPTION OF THE PREFERRED EMBODIMENTS

Figure 1:
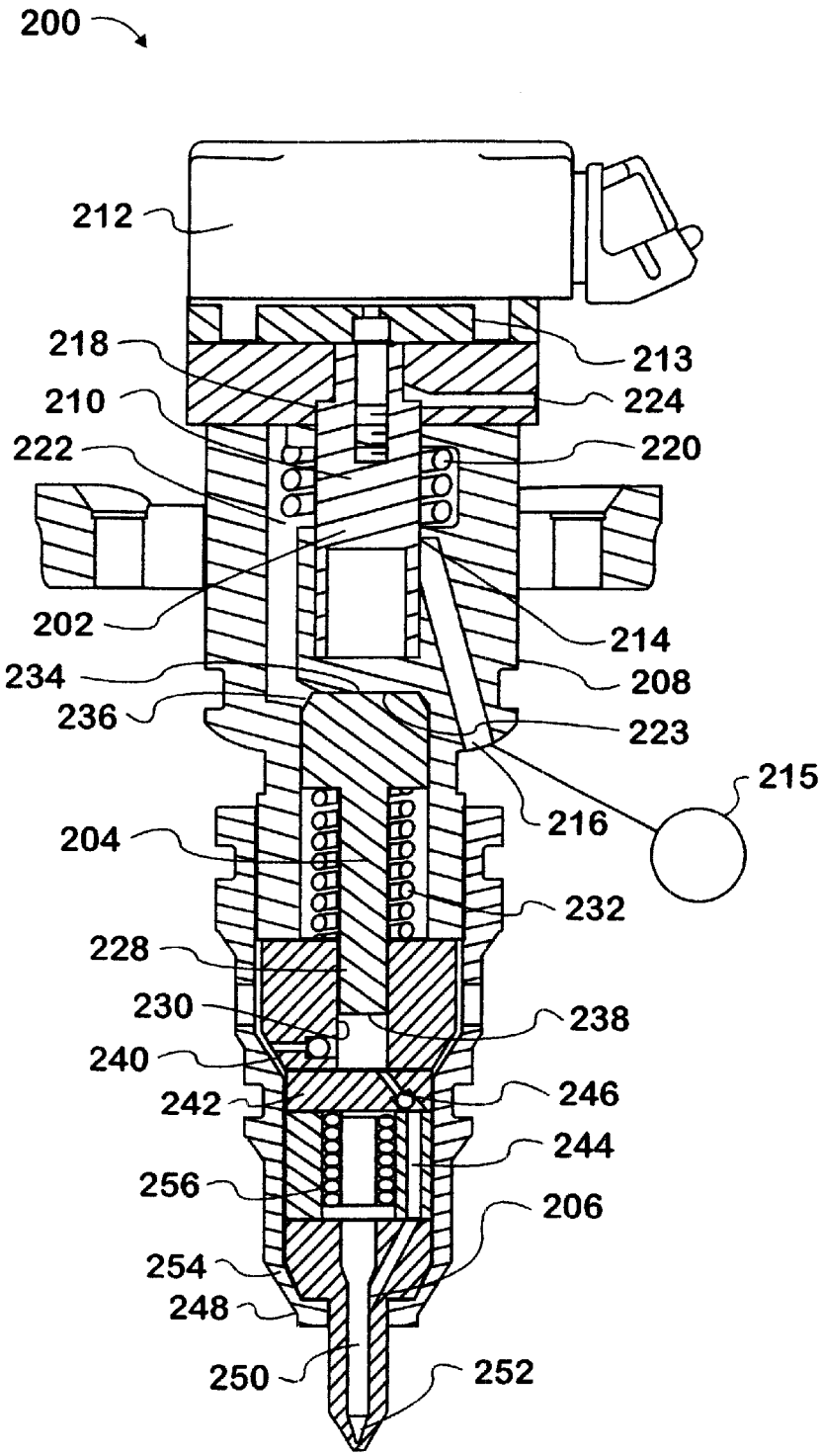
FIG. 1 PRIOR ART
FIG. 1 is a sectional elevational view of a prior art HEUI injector.
Figure 3:
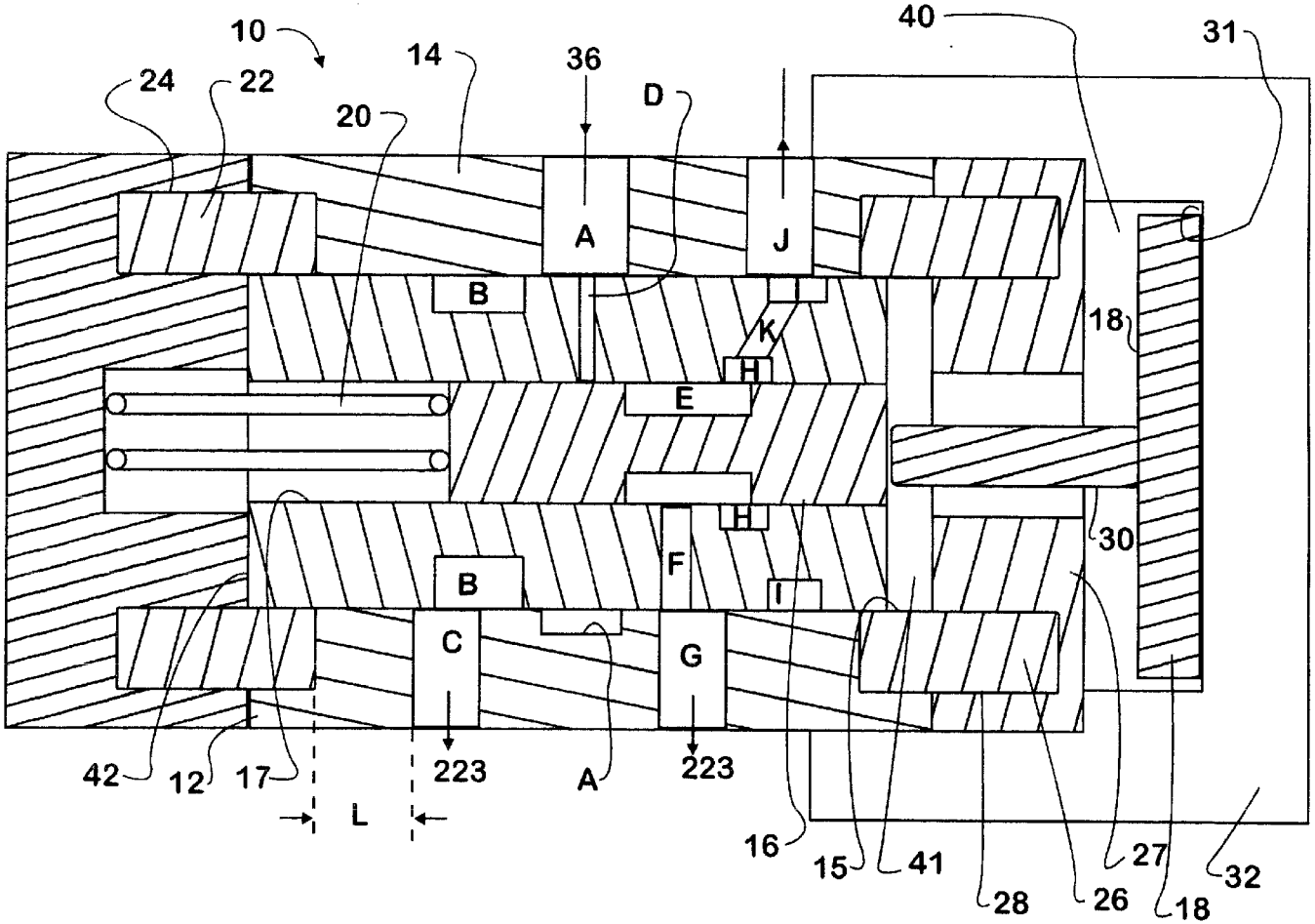
FIG. 3 is a sectional elevational view of the DATS valve.

The double-acting two-stage (DATS) control valve assembly of the present invention is shown generally at 10 in the figures. The basic structure of the DATS control valve assembly 10 is a valve inside of another valve. As shown in FIG. 3, the main components in the control valve assembly 10 are a valve housing 12, an outer spool valve 14, and inner spool valve 16, a push piston 18, an inner spool valve spring 20, a closing solenoid coil 22 and its end cap 24, and an opening solenoid coil 26 and its end cap 28. The valve housing 12, end caps 24, 28 and push piston stop 32 are all stationary pieces. The opening coil 26 may also be considered to be the double acting coil 26.

The outer spool valve 14 is shiftably disposed in a close fitting sealing relation with a cylinder bore 15 defined in the valve housing 12. The inner spool valve 16 is shiftably disposed in a close fitting fluid sealing relation within an axial cylinder bore 17 of the outer spool valve 14 for axially slidable movement therein, the friction between the inner and outer spools being controlled to a minimum level. The opening coil 26 and closing coil 22 are disposed adjacent the ends of the housing 12 on both sides to control the position of the outer spool valve 14. The push piston 18 includes an armature plate 19 disposed externally of the opening coil end cap 28 from the spool valves 14, 16 and a push pin 30 extending through the end cap 28 to contact one end of the inner spool 16. The push pin 30 may be integrally formed with the armature plate 19. The inner spool valve spring 20 is disposed in the bore 20 between the closing coil end cap 24 and the other end of the inner spool valve 16 to bias the inner spool valve 16 toward the opening coil 26 and the push piston 18 away from the opening coil 26 to a position abutting surface 31 of the push piston stop 32 disposed on the opening coil end of the housing 12 as shown in FIG. 3.

Both end caps 24, 28, valve housing 12, outer spool valve 14 and push piston 18 are all made with the same type of magnetic steel. Such magnetic steel conducts magnetic flux when either coil 22 or 26 is energized. The inner spool valve 16 is made out of non-magnetic steel and therefore has relatively poor magnetic conductivity. Accordingly, energizing coil 26 or coil 22 produces a negligible amount of flux on the inner spool valve 16. Motion of the inner valve spool 16 is caused only by the motion of the push piston 18 and by the bias of the spring 20. Biased spring 20 keeps the inner spool valve 16 in very close contact with the push piston 18. The push piston 18 and inner spool valve 16 move together under all operating conditions. Energizing the coil 22 attracts only the outer spool valve 14. Energizing the coil 26 attracts the outer spool valve 14 from one side to initiate rightward motion and the push piston 18 from the other side to initiate leftward motion. This two-sided attraction feature resulting in concurrent oppositely directed motion is referred to as being double-acting with a single coil. Both coils 22, 26 are substantially identical. The magnetic force produced from either coil 22, 26 on the outer spool valve 14 is substantially the same under zero air gap conditions.

During operation, the push piston 18 may be either attracted against the external side 27 of the end cap 28 by the opening coil 26 or biased by the spring 20 and inner spool 16 against the push piston stop 32. The push piston 18 has two positions. The first position is abutting the push piston stop 32 and the second position is magnetically latched on the external side of open coil end cap 28. The larger diameter armature 19 provides sufficient magnetic force when opening coil 26 is activated to be attracted towards the open coil end cap 28 outer surface 27 by overcoming the biasing force of the spring 20 from other end of the inner spool valve 16. The push piston air gap 40 is reduced to zero as push piston 18 is magnetically latched to the surface 27 of the end cap 28.

The inward side of the closing coil 22 attracts the outer spool valve 14 when the closing coil 22 is energized. Since inner spool valve has relatively poor magnetic conductivity and is relatively far away from the end cap 24, the magnetic force from the closing coil 22 acting on the inner spool valve 16 is negligible. When the coil 26 is activated, the outer spool valve 14 is attracted to the inward side of the end cap 28. The push piston 18 is also attracted toward the outer side of the end cap 28. The function of the coil 26 together with end cap 28 is to create an opposite direction of motion between the outer spool valve 14 and the inner spool valve 16. The relative position between the outer spool valve 14 and the inner spool valve 16 changes as both the push piston 18 and the outer spool valve 16 move towards the end cap 28. As the relative position between spools 14, 16 and valve housing 12 changes, the flow ports in the housing will open and close accordingly, as is described in detail below to effect the desired operating modes of hydraulic fluid flow.

FIGS. 4(*a*), 4(*b*) and 4(*c*) illustrate exemplary movements of the inner and outer spool valves 16, 14 within the housing 12. The flow area of a drain annulus H, an annulus to the bore 17 of the outer spool 14, is determined by the relative positions of the inner spool valve 16 and the outer spool valve 14. If the outer spool valve 14 is latched at the closing coil end cap 24, as shown in FIG. 3, the drain annulus H may be closed by activating open coil 26 to move the inner spool valve 16 with the push piston 18 toward the left. When the push piston 18 latches against the opening coil end cap 28, as shown in FIG. 4(*b*), the inner spool valve 16 is at its full leftward travel position and the drain annulus H is completely closed. In this position, a pilot passage D between the inner spool valve annulus E and the housing passage A is completely open and actuating fluid flows from pressure inlet 36 through pilot passage D to intensifier chamber 223, as indicated below. Motion of the inner spool valve 16 or of the outer spool valve 14 does not close the supply passage F defined in the outer spool 14. Supply passage F aligns with a supply passage G which is in fluid communication with the intensifier chamber 223 of the injector 8 (see FIG. 6 for a depiction of chamber 223).

The valve housing 12 provides the communication between the high pressure hydraulic actuating fluid source (inlet 36), the drain (drain port J), and the intensifier chamber 223 of the injector 8. Inlet port A is directly connected to high-pressure source 36. Drain port J is linked to the drain or reservoir of the engine at nearly ambient pressure by preferably spilling from the injector 8 under the engine valve cover. Supply port C allows in-flow of high pressure actuating fluid from inlet port A to the intensifier chamber 223 of the injector 8.

A second supply port G has a dual responsibility. It provides a fluid path for the high pressure flow from inlet port A through pilot passage D, annulus E, supply passage F to the intensifier chamber 223 of the injector 8. Supply port G also provides the fluid vent path for the venting of the actuating fluid from intensifier chamber 223 to flow through supply passage F, annulus E, drain annulus H, and drain annulus I. Drain annulus I is fluidly connected thereto to drain port J by passage L. Flow in all of the flow ports A, C, G, and J on the valve housing 12 is directly controlled by the position of the outer spool valve 14 relative to the housing 12. When the outer spool valve 14 shifts from abutting one end cap 24 or 28 to the other end cap 28 or 24 (as the case may be) either the supply annulus B or the drain annulus I on the outer spool valve 14 will be open to the ports, while the other annulus B or I is closed by the valve housing 12.

Pilot passage D is always open to the high pressure inlet port A. However, whether the pilot passage D opens to the intensifier chamber 223 is determined by the position of the inner spool valve 16 relative to the outer spool valve 14. When the push piston 18 is latched against the open coil end cap 28, as shown in FIGS. 4(*b*) and 4(*c*), the pilot passage D is open to intensifier chamber 223 so that high pressure actuating fluid can flow from inlet port A through pilot passage D to inner spool annulus E to supply port G to the intensifier chamber 223 of the injector 8. It is desired to make the flow area through pilot passage D very small, preferably about 10% of the flow area of the larger outer spool valve supply annulus B. With very restricted actuator fluid flow through the pilot passage D to the intensifier chamber 223 of the injector 8, the actuation process of the intensifier 204 is controlled at a desirable relatively stable and slow rate. The outer spool valve 14, along with the two end caps 24, 28 and coils 22, 26, performs the basic digital valve concept as illustrated in prior art FIG. 2. The outer spool valve 14 is attracted from one coil side to the other coil side depending on which coil 22, 26 is actuated.

Figure 5:
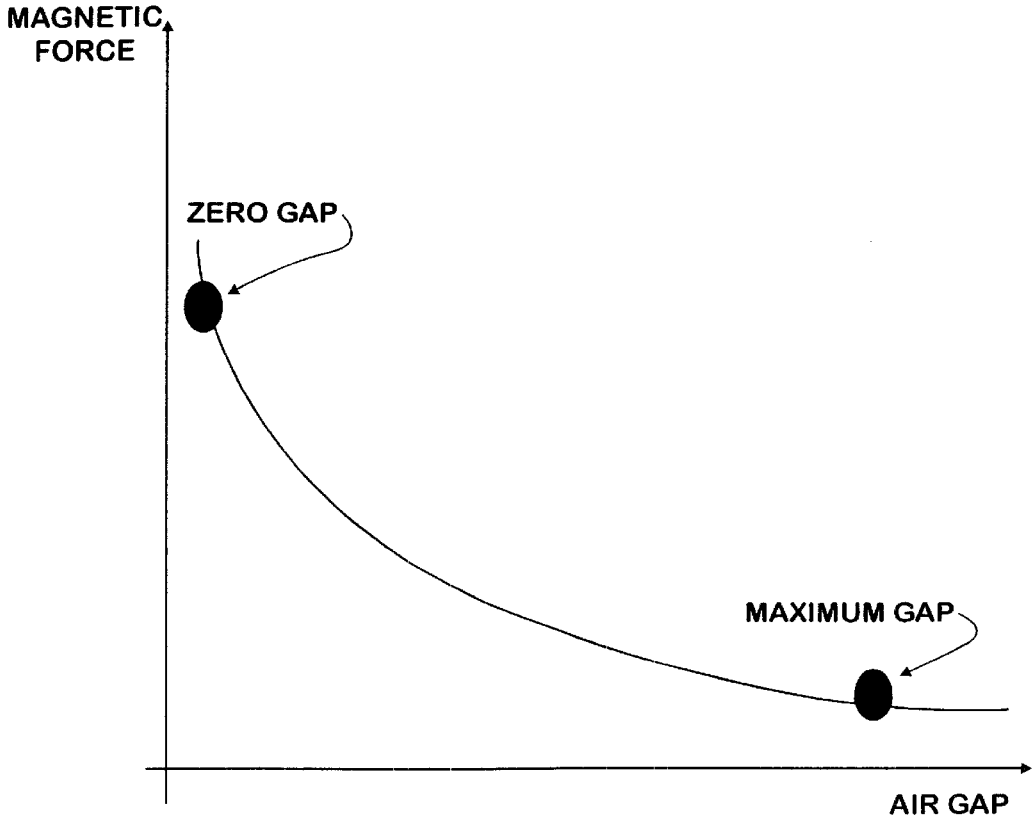
FIG. 5 is a graphic representation of magnetic force as it relates to air gap.

FIG. 5 illustrates the theory that the magnetic force is function of the air gap for a given current level. As depicted in FIG. 3, the shifting of the spool valves 14, 16 variously opens and closes push piston air gap 40, open solenoid air gap 41 and close solenoid air gap 42. The theory of FIG. 5 applies to each of the air gaps 40–42. The magnetic force level is significantly less if the spool valve is at the remote position (air gap is large). The maximum force level will be reached when spool valve is latched to the end cap of a coil which is energized.

It is highly desirable that the closing coil 22 generate equal or greater maximum magnetic force (force at zero gap)

than the force generated by the opening coil 26. By doing this, the following features are achieved:

(1) If the opening coil 26 is de-energized and the closing coil 22 is energized, the outer spool valve 14 will be latched at the closing coil side end cap 24. Since the opening coil 26 is de-energized, the inner spool valve 16 along with push piston 18 will be pushed to the push piston stop 32 (away from the opening coil 26) by the pre-loaded force of the spring 20. The spools 14, 16 will thus be in the positions shown in FIG. 4(*a*).

(2) If the closing coil 22 is energized and the outer spool valve 14 is latched on the closing coil side end cap 24, simultaneously energizing the opening coil 26 cannot cause the outer spool valve 14 to move because due to magnetic force and gap theory. The magnetic force produced on the closing coil side 22 is greater than on the opening coil 26 side because there is no air gap between the spool 14 and end cap 24 while there is a maximum air gap on the opening coil side between spool 14 and end cap 28. See FIGS. 3, 4*a*, and 4*b*. However, energizing the opening coil 26 will move the push piston 18 to engage the external side 27 of the opening coil end cap 28, resulting in the spool valves 14, 16 assuming the positions shown in FIG. 4(*b*).

(3) If the outer spool valve 14 is on the closing coil side (see FIG. 4*b*), and the closing coil 22 is not energized, energizing the opening coil 26 will move both the outer spool valve 14 and the push piston 18 toward opening coil. This causes both the spool valves 14, 16 to move in relatively opposite directions to achieve the relative positions shown in FIG. 4*c*. The outer spool valve 14 shifts rightward and the inner spool valve 16 shifts leftward responsive to energizing the open coil 26.

Figure 6:
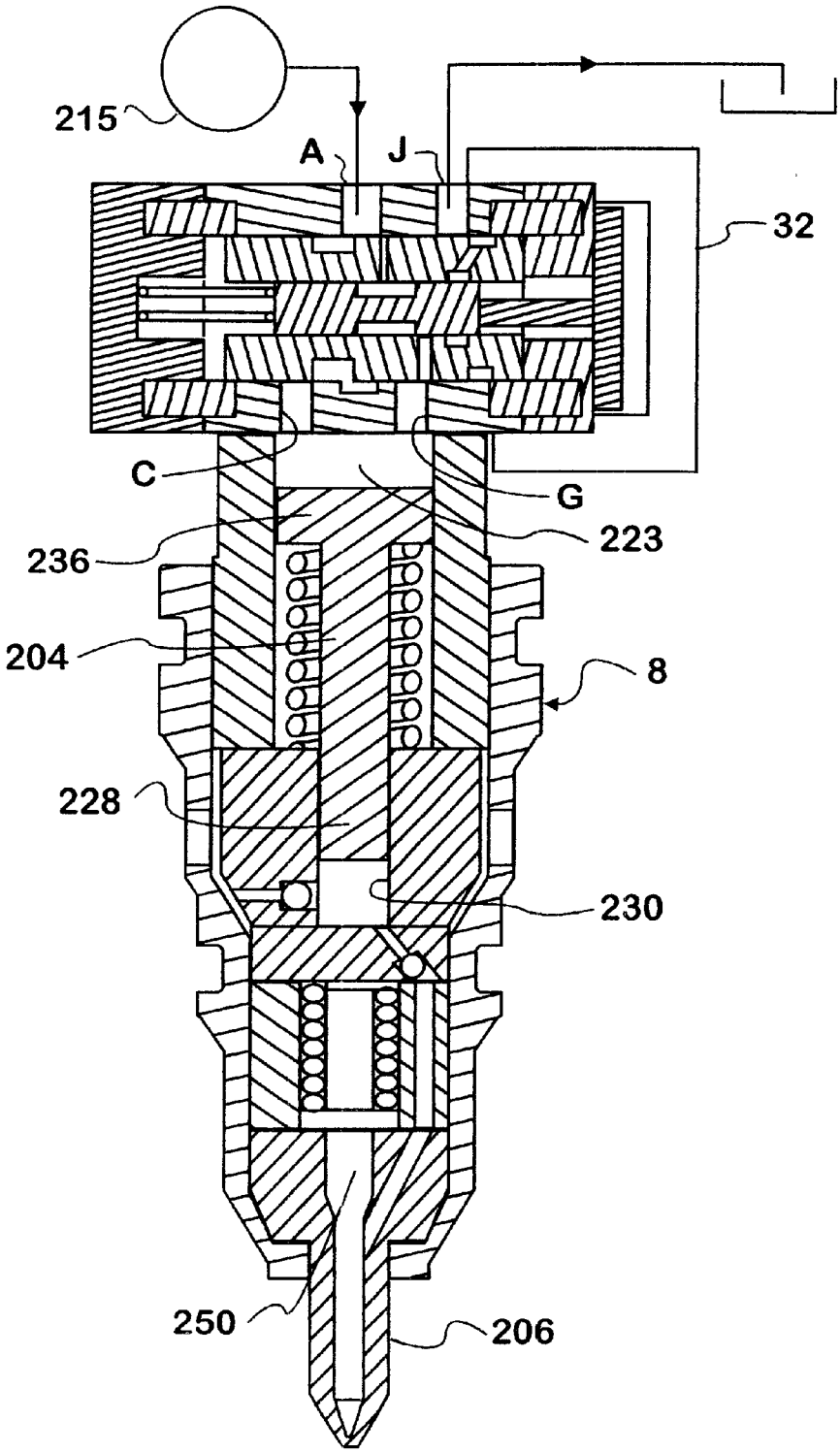
FIG. 6 is a sectional elevational view of an exemplary injector incorporating the present invention.

FIG. 6 shows the DATS control valve 10 mounted to in a HEUI injector 8, including an intensifier chamber 223, an intensifier piston 236 operatively connected to intensifier plunger 228 so that, upon high pressure actuating fluid being supplied to the intensifier chamber by the DATS control valve 10, the intensifier piston forces the plunger 228 into the fuel chamber 230, there by causing the fuel to enter the injection nozzle 206, lift the needle valve 250 and eject fuel from the nozzle 206. Operation of the intensifier and nozzle portions of the injector 8 is similar to those portions of the prior art injectors described above.

DATS Injector Operation

FIGS. 4(*a*), 4(*b*), and 4(*c*) illustrate the operation of the DATS valve 10 of the present invention for obtaining flexible control of different stages of fuel injection flow rates and volumes.

FIG. 4(*a*) shows both spool valve 14, 16 positioned in the drain configuration or non-working mode of the injector. In this drain mode position, the intensifier chamber 223 of the injector 8 is vented to the ambient pressure through drain passageways G, F, E, H, I, J, and K. During the drain process, the closing coil 22 is energized, and the opening coil 26 is de-energized. Consequently, the outer spool valve 14 is magnetically latched in the most leftward disposition to the closing coil end cap 24 while the inner spool valve 16 and the push piston 18 are being pushed by the spring 20 against the push piston stop 32 (the most rightward disposition). The pilot passage D is sealed by the land 43 of the inner spool valve 16. The drain annuluses H and I are wide open. The main flow port A is also fully sealed by land 44 of the outer spool valve 14. The closing coil 22 is de-energized when the spool valve 14 is in the drain position. The outer spool valve 14 will remain latched to the closing coil end cap until the next injection event due to residual magnetic force.

Figure 4A:
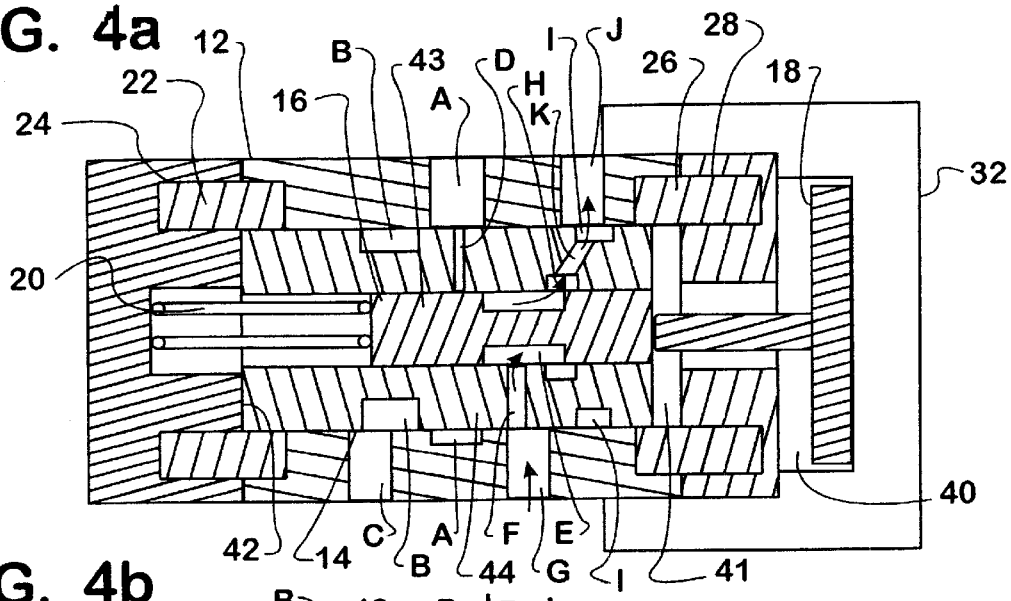
FIG. 4*a* is a sectional elevational view of the DATS valve in the non-working (drain) mode of operation.
Figure 4B:
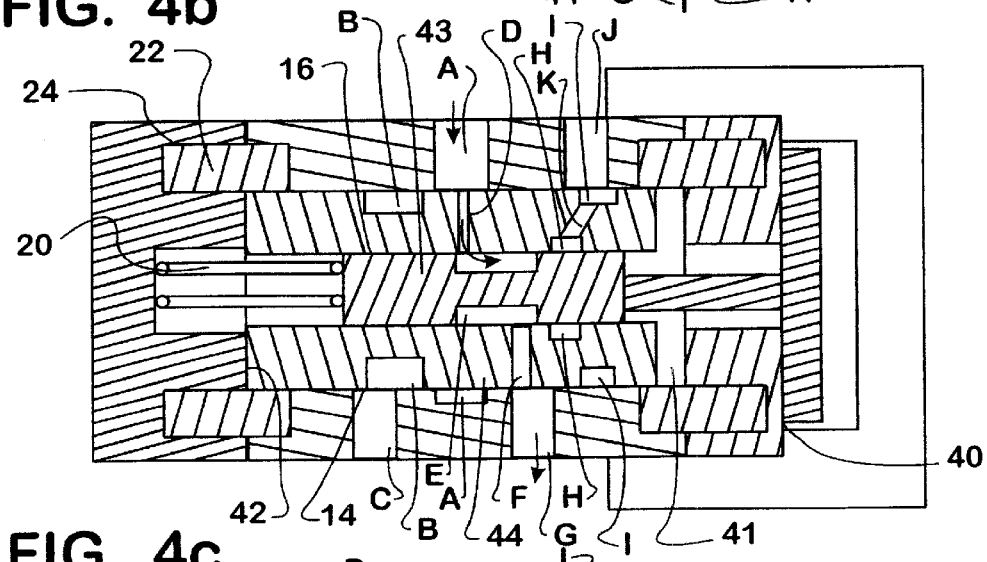
FIG. 4*b* is a sectional elevational view of the DATS valve in the pilot flow mode of operation.

FIG. 4(*b*) shows the pilot mode configuration of the control valve 10. This position is preferably commanded in the initial portion of an injection event. Very often, a small volume of actuator fluid flow into the intensifier is preferred during the initial portion of an injection event. This small flow stage is operated in following way. The close coil 22 is energized first and is kept on for a predetermined time during the pilot injection portion of the injection event. The open coil 26 is de-energized. The outer spool valve 14 is thus attracted to the closing coil side and is latched to the end cap 24 to assure the main inlet flow port is initially fully closed. At this point, the pilot passage D is also fully closed by land 43 of inner spool valve 16 as depicted in FIG. 4*a*.

With the outer spool valve 14 secured on the closing coil side end cap 24, the opening coil 26 is energized to attract the push piston 18, thereby moving the inner spool valve leftward compressing spring 20 to open the pilot passage D. High pressure actuating fluid is admitted through the pilot passage D, E, F, G, to the intensifier chamber 223. The flow rate at this condition is limited to a small and very stable and controllable level. The motion of the intensifier piston 236 will be relatively slow due to the slow flow rate of actuating fluid flow through the pilot passage D. At the end of the pilot injection portion of the injection event, the opening coil 26 is de-energized. The inner spool valve 16 then shifts rightward under the bias of the spring 20, sealing off the pilot passage D and to provide a dwell period between the pilot injection portion and either the main injection portion of the injection event or a subsequent pilot injection portion of the injection event or to end the injection event, as desired. The rightward shifting of the inner spool valve 16 terminates pilot injection.

FIG. 4(*c*) shows main flow configuration for the main injection portion of the injection event. Under this condition, a larger volume of high pressure actuating fluid is allowed to flow into the intensifier chamber 223 of the injector 8 through both main flow passages C and G. To achieve this, the closing coil 22 is de-energized and the opening coil 26 is energized. Both the outer spool valve 14 and the push piston 18 are latched against opening coil end cap 28. The outer spool valve 14 is in its rightmost disposition. The inner spool valve 16 is in its leftmost disposition, compressing spring 20. In this position, the main flow annulus B is open to actuating fluid supply inlet port A. The pilot passage D is still open, augmenting the main flow while the drain annulus H is closed. However, it should be noted that if the pilot passage size is very small, the pilot passage flow may be negligible compared to the main flow.

DATS Valve Application on Fuel Injection

The DATS valve 10 of the present invention has a broad range of application in the field of hydraulic control. The fundamental feature of this valve 10 is its ability to provide two-stage flow with flexible controllability. When a small flow rate is desired, the DATS valve 10 can be locked in a first position to provide, for example, a pilot mode of operation. When a large flow quantity is desired, the DATS valve 10 can be locked in a second position to provide, for example, a main flow mode of operation. The duration of each mode of operation is flexibly controlled through a pulse-width control modulation to the coils 22, 26.

A direct application of the DATS valve 10 is in the diesel fuel injection area. As indicated through the analysis of the prior art injector, it is highly desirable to improve the prior art digital spool valve control for flexible injection operation. The small flow mode is used for pilot injection operation to achieve both controllability and stability. The larger flow mode can be used for main injection operation to achieve high injection pressure and improve injection efficiency.

Figure 7:
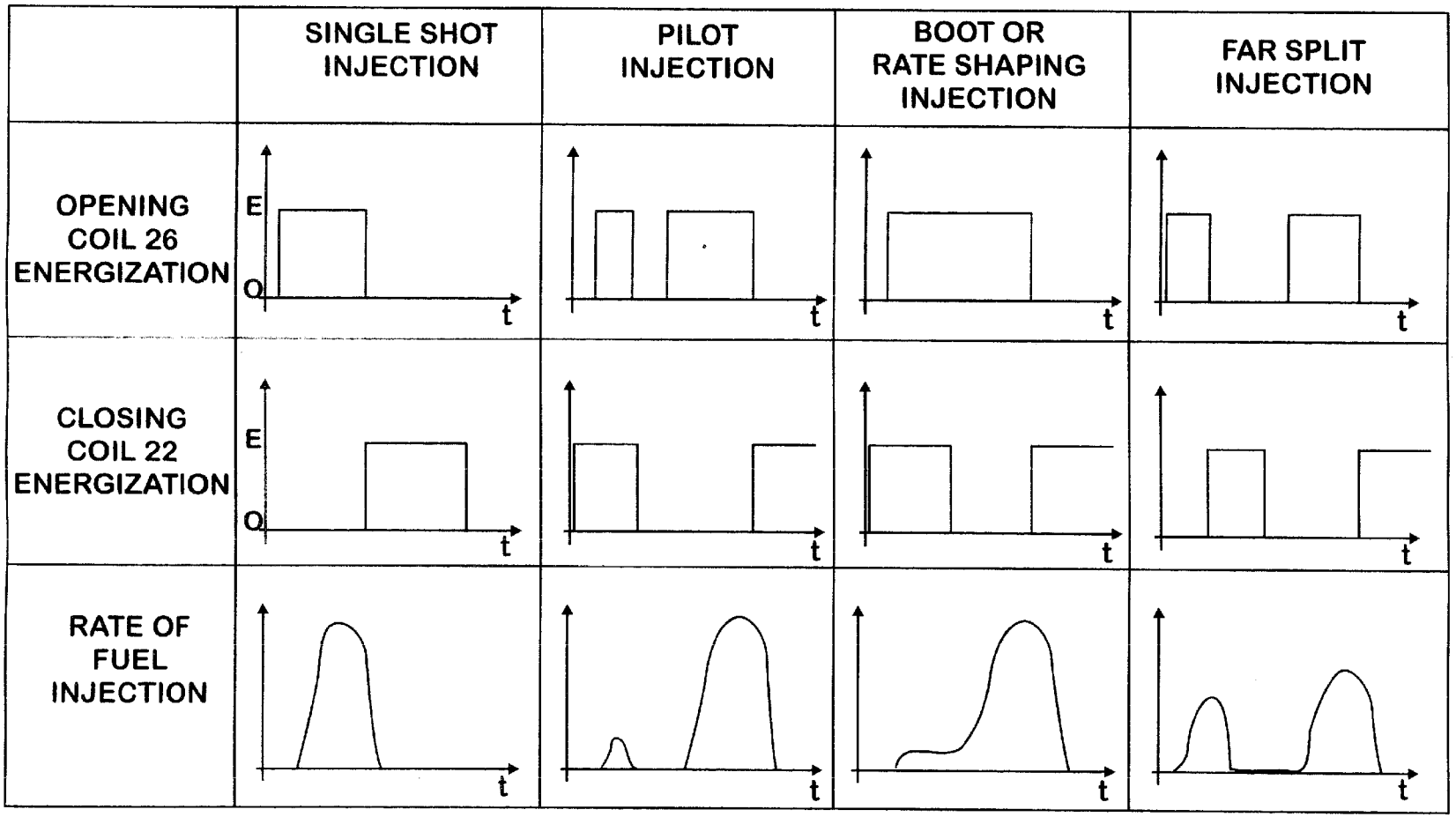
FIG. 7 is a series of graphic representations of the energization states of the opening and closing coils as they relate to various modes of operation and rates of injection.

The opening coil 26 and the closing coil 22 of the DATS control valve 10 are energized and de-energized under the control of a programmed engine control microprocessor (not shown) to provide various methods of operation of the DATS injector 8 and the engine. As shown in FIG. 7, the coils 22, 26 are energized at E and de-energized at 0. The following fuel injection strategies are possible with the DATS control valve 10:

(1) Single Shot Injection

Figure 4C:
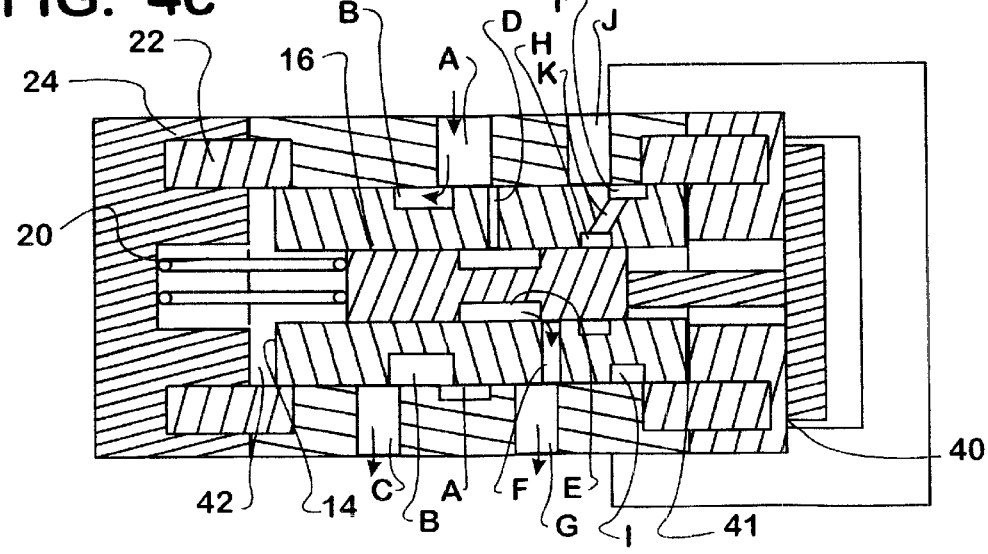
FIG. 4*c* is a sectional elevational view of the DATS valve in the main flow mode of operation.

Prior to the start of an injection event, both the inner and outer spool valves 14, 16 are in the drain configuration shown in FIG. 4(*a*). The open coil 26 is energized first attracting both the outer spool valve 14 and the push piston 18, acting on the inner spool valve 16, to move to the open coil end cap 28. The main injection configuration shown in FIG. 4(*c*) is then achieved. In this configuration, a large flow of high pressure actuating fluid flows into the intensifier chamber 223 of the injector 8. With a high flow rate and high pressure at the intensifier chamber, the injection pressure at the nozzle 206 builds up quickly and fuel injection occurring under this condition is eruptive and very efficient. Most engine operation under high speed conditions utilize this injection strategy. At end of the injection event, the closing coil 22 is energized and the opening coil 26 is de-energized. The outer spool valve 14 returns to the closing coil end cap 24. The inner spool valve 16 moves in the opposite direction due to the spring 20 and both the main flow port A and pilot passage D are closed while the drain annuluses H and I open up to vent the intensifier chamber 223 to end the injection event, thereby leaving the components in the drain configuration. Subsequently, the closing coil 22 is de-energized until the next injection event, residual magnetism holding the control valve 10 in the configuration of FIG. 4*c*.

(2) Pilot Injection

Pilot injection is achieved by the following operation strategy. The closing coil 22 is energized first to assure that the outer spool valve 14 shifts leftward and stays latched on the closing coil side end cap 24. See FIG. 4*b*. When the outer spool valve 14 is latched on the closing coil side end cap 24, energizing the opening coil 26 can only make the inner spool valve 16 move leftward to open pilot passage D so that a small quantity of high pressure actuating fluid flows from the high pressure input port A into the intensifier chamber 223. With a small actuating fluid flow rate, fuel injection starts slowly and very steady. The opening coil 26 is de-energized when the desired quantity of pilot fuel injection is achieved which is proportional to the pulse width duration applied to the opening coil 26. Such de-energization frees the spring 20 to shift the inner spool valve 16 rightward, sealing off the pilot passage D. See FIG. 4*a*. Pilot injection ends when the drain port J opens as the inner spool valve 16 returns to the drain configuration.

The injector 8 is in the dwell period between injection events. Both the opening and closing coils 22, 26 may be de-energized. At the end of the dwell period, the opening coil 26 is energized again while the closing coil 22 stays de-energized at the initiation of the succeeding injection event. The outer spool valve 14 and the push piston 18 are thereby caused to shift toward the opening coil end cap 28 resulting in the main injection configuration. The outer spool valve 14 is in its rightmost disposition and the inner spool valve 16 is in its leftmost disposition. As above, the main flow of high pressure actuating fluid flows from the high pressure input port A in to the intensifier chamber 223 through both the main flow path (passage A to B to C) and the pilot flow path (passage A to D to E to F) to provide main injection. At end of main injection, the closing coil 22 is energized and the opening coil 26 is de-energized. The intensifier chamber 223 is vented through the drain annuluses H and I and all components go back to the drain configuration. Pilot injection strategy is regarded as the most important injection strategy to provide low noise and low emissions from the engine.

Boot or Rate-shaping Injection

Boot or rate-shaping injection is similar to pilot injection described above but without an obvious dwell period between the pilot injection and the main injection. Boot injection is characterized by a small injection flow rate occurring before the main injection starts (the rate of injection curve over time appearing similar to the outline of a boot). It is highly desired to have flexibly control both the initial low rate of fuel injection and the subsequent high rate of fuel injection. With the injector 8 having the DATS control valve, the small quantity of the initial portion of injection is achieved by the flow through pilot passage D and thence to passages E and F to chamber 223. Similar to pilot operation discussed above, the closing coil 22 is energized first to latch the outer spool valve 14 on the closing coil side end cap 24. The opening coil 26 is then energized resulting in L to deliver the pilot flow quantity. Injection starts but at a very small injection flow rate. When the desired initial low rate of injection duration is achieved, the closing coil 22 is then de-energized to release the outer spool valve 14. Since the opening coil 26 is still energized, the outer spool valve 14 soon shifts to latch on the opening coil side end cap 28. The main injection flow starts as a function of the shifting of the outer spool valve 14 while the pilot flow still continues. The end of the injection event is achieved by de-energizing the open coil 26 and energizing the close coil 22. The control valve 10 reverts to the disposition of FIG. 4*a*.

(4) Far Split Injections

This injection strategy is very often used at engine idle and cold engine operations. Far split injection is two single injections of low (but greater than pilot quantity) occurring in close sequence within the same injection event. The operation of the DATS control valve 10 for this strategy is to operate the Single Shot Injection strategy described above and, at the end of the injection described above and within the same injection event or engine cycle, de-energizing the closing coil 22 and energizing the opening coil 26 to achieve a second single shot injection. The far split injection is ended by de-energizing the opening coil 26 and energizing the closing coil 22 to end the injection event with the control valve 10 in the drain configuration after which the closing coil may be de-energized to await the next injection event.

DATS Valve 10 with Sleeve Design

Figure 8:
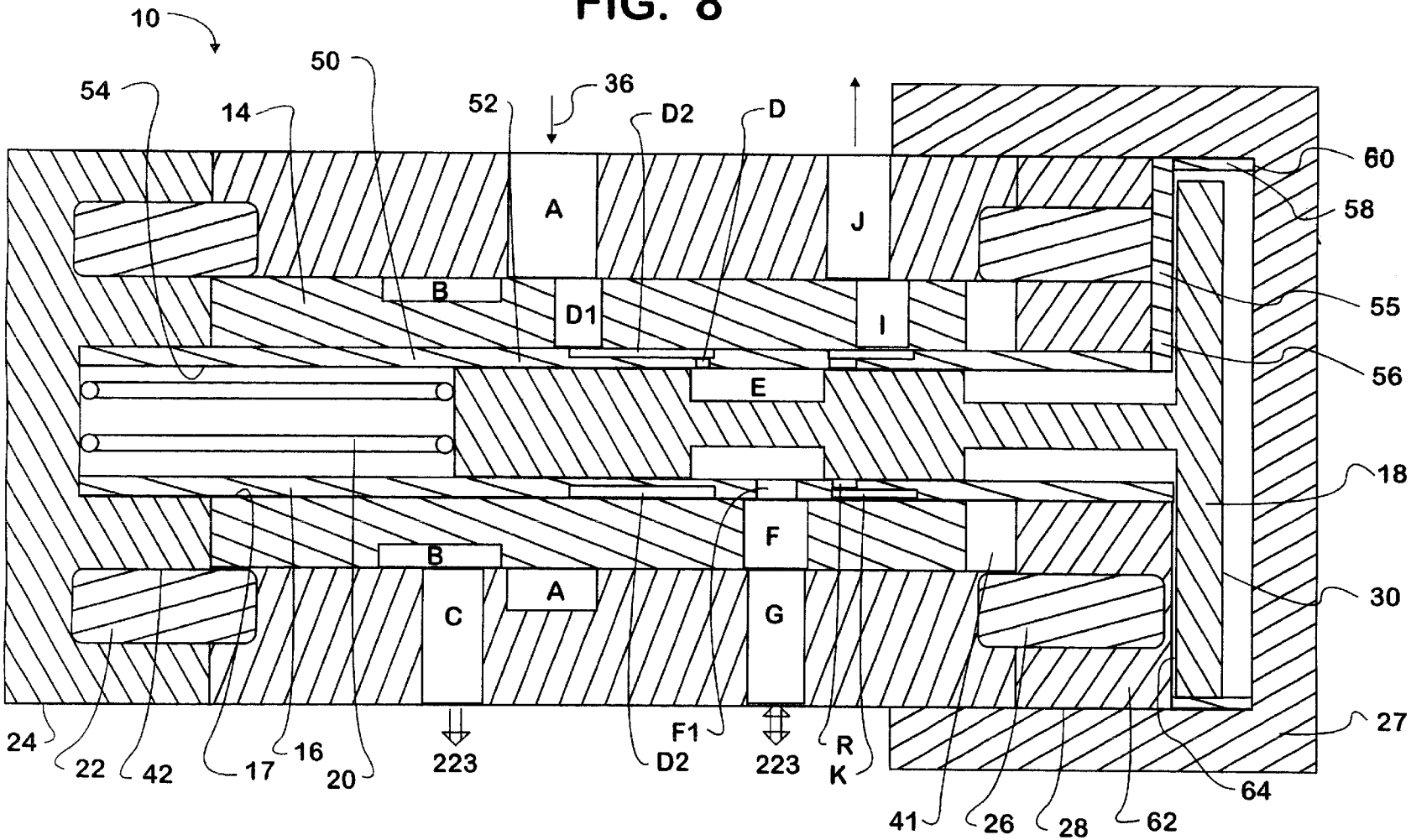
FIG. 8 is a schematic view of a sleeve design embodiment of the DATS valve at pilot flow mode.

FIG. 8 illustrates a schematic of the DATS valve 10 with a sleeve design, a further embodiment of the present invention. A sleeve 50 is placed between the outer spool valve 14 and the inner spool valve 16. The sleeve 50 is a simple cylindrical shape having an axial bore defined in the center. The sleeve 50 is preferably made out of non-magnetic material and is stationary in all modes of operation. There are several flow passages defined in the sleeve body 52 to provide flow communication between the inner spool valve 16 and the outer spool valve 14. The DATS valve including the sleeve 50 provides at least three advantages.

The direct friction is avoided between the inner spool valve 16 and the outer spool valve 14 that would otherwise arise due to oppositely directed motion. By eliminating this friction, motion variability due to relative motion is minimized.

The design also provides manufacturing simplicity. As shown on FIG. 3, an internal groove drilling process is required to produce the groove R to drain the fluid to ambient. This internal drilling process can be relatively difficult when the diameter of the inner spool valve 16 is relatively small. With the DATS valve including sleeve 50, all internal drillings are replaced by external grooves and bores, which are much easier to form during manufacturing. As shown on FIG. 8, bores R and outer groove K are used to replace the inner groove R on FIG. 3.

Figure 9:
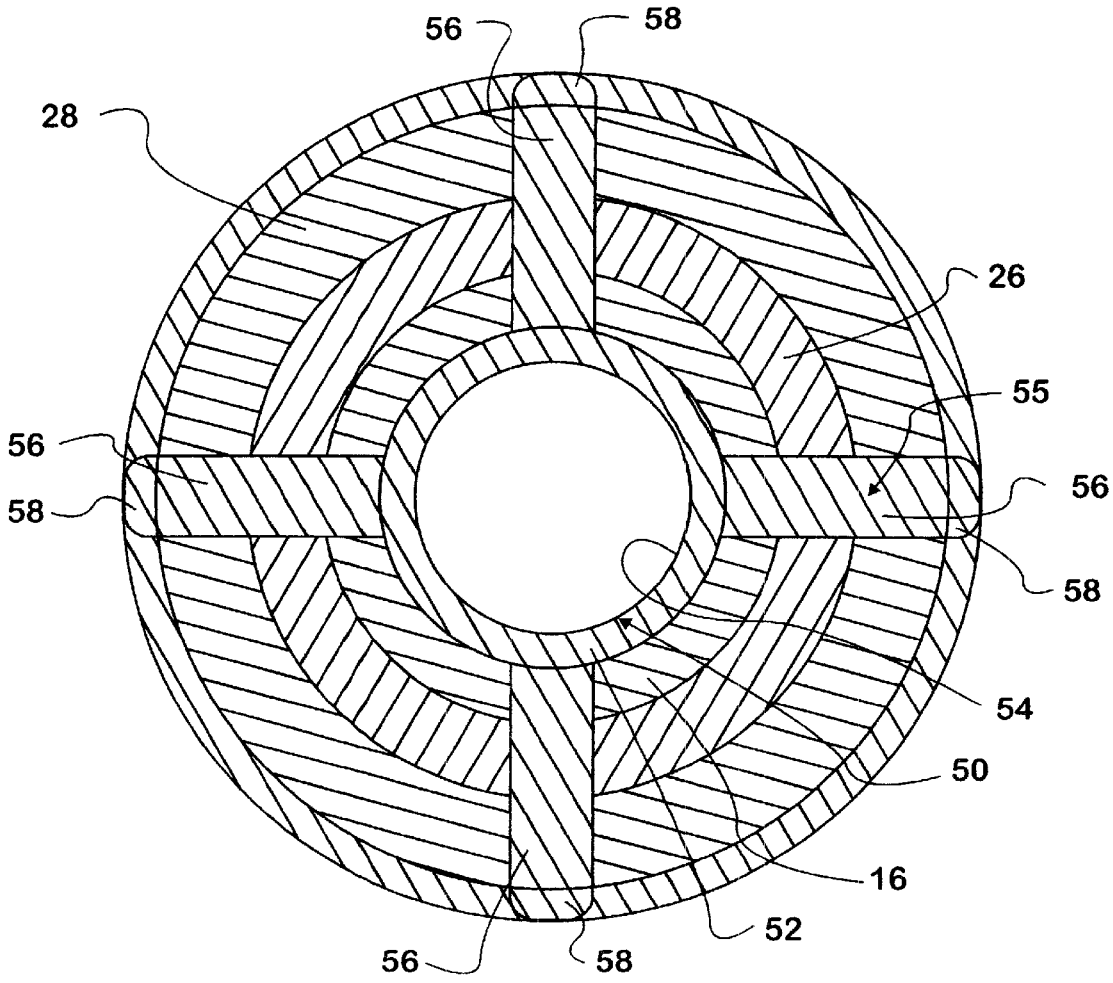
FIG. 9 is a right side view of sleeve wheel structure of FIG. 8.

The sleeve 50 has a simple cylindrical body 52 with a wheel type structure on the double-acting coil 26 side. The cylindrical body 52 has an axial bore 54. The inner spool valve 16 is translatably disposed in the bore 54. FIGS. 5, 8 and 9 show a schematic of the wheel type configuration of the body 52. The wheel structure 55 includes a plurality of spokes 56. Each spoke 56 has a tip 58 having an end margin 60 that abuts the surface 31 of the stop 32. The wheel structure 55 and the end cap 28 are preferably bonded together through a proper welding technique. When the push piston 18 moves towards end cap 28, the push piston 18 contacts the wheel spokes 56 and does not directly contact the end cap surface 62 as shown by a small air gap 64 on FIG. 8 in the right lower corner. There is a very small gap 64 remaining between push piston 18 and end cap 28. Due to this slight air gap 64, the maximum magnetic force is slightly reduced (on the order of approximately 5%). This reduction can be considered to be negligible. The wheel type structure 55 secures the overall assembly structure of the valve 10 and prevents any structural damage caused by a high speed impact of the push piston 18 on the end cap surface 64. Such impact would occur absent the interventions of the spokes 56 to arrest the leftward travel of the push piston 18. Since the sleeve wheel structure 55 is non-magnetic and the wheel structure 55 has only few wheel spokes 56, the magnetic flux path remains nearly the same as the path of the embodiment of FIG. 3. There is enough magnetic area for flux to directly travel through the air gap or to go around the wheel spokes 56 through the air gap to the push piston 18 to generate sufficient magnetic force on the push piston 18.

During pilot flow operation, the outer spool valve 14 is secured at the end cap 24 by energizing the closing coil 22. This latches the outer spool valve 14 The main flow port B is closed. The opening coil 26 is then turned on. The push piston 18 starts to move leftward towards the opening end cap 28 under influence of the magnetic force generated by the opening coil 26. As the inner spool valve 16 moves to the left with the push piston 18, the inner spool valve 16 opens the pilot flow hole D and closes venting hole R. A limited flow rate passes from the inlet 36 through A, D1, D2 and the restricted area D. Flow is then through F1, F and G to the actuator (chamber 223).

The drain passages R, K J, and I are completely shut off when the push piston 18 is arrested on the spokes 56 of the wheel structure 55. In this mode of operation, the flow from inlet 36 to the actuator (intensifier chamber 223) is controlled at a selected relatively small flow rate. The size of pilot bore D is used to achieve the desired small flow rate.

This pilot flow mode is ended by de-energizing the coil 26. The spring 20 then pushes the inner spool valve 16 and the push piston 18 to the rightmost position, thereby closing bore D and opening vent bore R. Actuating fluid is then vented from G to F and F1, to R and then outward through I and J to the outlet.

During main flow operation, the closing coil 22 is de-energized and the opening coil 26 is activated. Both the outer spool valve 16 and the push piston 18 are simultaneously moved towards the end cap 28, the outer spool valve 16 moving rightward and the push piston 18 moving leftward on both the inner and outer surfaces of the stationary sleeve 50. This countermotion causes the main flow port B to open and a significant amount of flow occurs from inlet 36 through A, through groove B to actuation port C and then to the actuator (chamber 223). At the same time, pilot flow also flows through bore D1, sleeve groove D2, pilot bore D, annulus E, bore F1 and F to port G to chamber 223. The venting port R is blocked by the inner spool valve 16 completely. End of the main flow is achieved by energizing the coil 22 and at the same time de-energizing the coil 26

What is claimed is:

1. A method of controlling injection strategy of an injection event of a hydraulically actuated intensified fuel injector, comprising:

fluidly coupling a source of actuating fluid to a control valve assembly;

providing a drain for draining spent actuating fluid from the control valve assembly;

fluidly coupling the control valve assembly to an injector intensifier chamber;

effecting the desired injection strategy by independently controlling the shifting of two valves in the control valve assembly to selectively control a flow of actuating fluid to the intensifier chamber through at least one parallel flow path to a common terminus and to drain spent actuating fluid from the intensifier chamber.

2. The method of claim 1 including controlling the shifting of the two valves to provide at least for injection strategies of single shot injection, pilot injection, rate shaping injection and far split injection.

3. The method of claim 2 including controlling the shifting of a first valve of the two valves by means of a pair of spaced apart, independently energizeable solenoids.

4. The method of claim 3 including controlling the shifting of a second valve of the two valves by means of a one of the pair of solenoids in cooperation with a bias exerted on the second valve.

5. The method of claim 4 including shifting the first valve of the two valves and the second valve of the two valves substantially simultaneously in opposing directions to achieve a desired configuration.

6. The method of claim 5 including sizing the inlet annulus such that flow of actuating fluid therethrough is relatively unrestricted.

7. The method of claim 4 including shifting the second valve relative to the first valve to simultaneously align a pilot passage of the first valve, a groove of the second valve, and a fluid coupling with the source of actuating fluid with a fluid coupling to the intensifier chamber.

8. The method of claim 7 including sizing the pilot passage such that flow of actuating fluid therethrough is relatively restricted.

9. The method of claim 5 including:

shifting the first valve such that the inlet annulus of the first valve is not aligned with the fluid coupling with the source of high pressure actuating fluid; and shifting the second valve relative to the first valve such that the pilot passage of the first valve is not aligned with the source of high pressure actuating fluid and simultaneously aligning a fluid coupling to the intensifier chamber with a groove in the second valve, a drain passage defined in the first valve, and the drain for spent actuating fluid from the control valve assembly.

10. A method of controlling the fuel injection from a hydraulically actuated intensified fuel injector comprising:

i. fluidly coupling a control valve assembly to a source of actuating fluid;

ii. selectively alternatively configuring the control valve assembly with two valves with two valves to;

1. a vent disposition to vent the actuating fluid;
2. a pilot disposition to convey a first certain volume of working fluid through a first of two parallel flow paths to effect a pilot fuel injection event; and
3. a main injection disposition to convey a second certain volume through at least the second of the two parallel flow paths of working fluid to effect a main fuel injection event, the two parallel flow paths having a common terminus.

11. The method of claim 10 including providing a relatively low rate of actuating fluid flow in the pilot disposition and providing a relatively high rate of actuating fluid flow in the main injection disposition.

12. The method of claim 10 including controlling the shifting of a first valve of the control valve assembly by means of a pair of spaced apart solenoids, a first of the pair of solenoids acting to shift the first valve in a first direction and the second of the pair of solenoids acting to shift the first valve in a second opposite direction.

13. The method of claim 12 including controlling the shifting of a second valve of the control valve assembly in two opposing directions: by means of a one of the pair of solenoids in cooperation with a bias exerted on the second valve.

14. The method of claim 13 including shifting the first valve to align an inlet annulus of the first valve and a fluid coupling with the source of actuating fluid and a fluid coupling to the actuator.

15. The method of claim 14 including the step of sizing the inlet annulus such that flow of high pressure actuating fluid therethrough is relatively unrestricted.

16. The method of claim 13 including the step of shifting the second valve relative to the first valve to simultaneously align a pilot bore defined in the sleeve, a groove of the second valve, and a fluid coupling with the source of high pressure actuating and with a fluid coupling to the intensifier chamber.

17. The method of claim 16 including the step of sizing the pilot bore such that flow of actuating fluid therethrough is relatively restricted.

18. The method of claim 12 including disposing the first and second valves In a coaxial disposition, one within the other.

19. The method of claim 18 including simultaneously shifting the first and second valves in opposing directions to achieve at least one operating mode.

20. The method of claim 19 including minimizing frictional forces generated between the first and second valves by interposing a sleeve between the first and second valves.

21. The method of claim 20 including shifting the first valve relative to a sleeve external surface and shifting the second valve relative to an internal sleeve surface, the sleeve being held stationary.

* * * * *